US012117268B1

(12) United States Patent
Wang

(10) Patent No.: US 12,117,268 B1
(45) Date of Patent: Oct. 15, 2024

(54) SIGHT CAPABLE OF SWITCHING RETICLES, METHOD, AND DEVICE

(71) Applicant: Peng Wang, Yueyang (CN)

(72) Inventor: Peng Wang, Yueyang (CN)

( * ) Notice: Subject to any disclaimer, the term of this patent is extended or adjusted under 35 U.S.C. 154(b) by 0 days.

(21) Appl. No.: 18/511,893

(22) Filed: Nov. 16, 2023

(51) Int. Cl.
*F41G 1/473* (2006.01)
*F41G 1/38* (2006.01)

(52) U.S. Cl.
CPC ..... *F41G 1/38* (2013.01); *F41G 1/473* (2013.01)

(58) Field of Classification Search
CPC ..... F41G 1/38; F41G 1/40; F41G 1/46; F41G 1/467; F41G 1/473
USPC ..... 33/297, 298
See application file for complete search history.

(56) References Cited

U.S. PATENT DOCUMENTS 3,470,616 A * 10/1969 Thompson ..... G02B 27/32 33/297
5,491,546 A * 2/1996 Wascher ..... F41G 1/38 356/3
7,652,818 B2 * 1/2010 Wagner ..... F41G 1/38 359/424
8,833,655 B2 * 9/2014 McCarty ..... F41G 1/00 359/422
9,297,615 B2 * 3/2016 Meinert ..... F41C 23/16
9,784,575 B2 * 10/2017 Senne ..... F41G 1/38
10,393,480 B2 * 8/2019 Buchsbaum ..... G03H 1/0005
10,415,933 B1 * 9/2019 Kleck ..... F41G 3/06
10,823,530 B1 * 11/2020 Wilson ..... F41G 1/12
10,942,007 B1 * 3/2021 Partney ..... F41G 3/165
10,976,135 B1 * 4/2021 Holland ..... F41G 1/38
11,041,694 B1 * 6/2021 Holland ..... F41G 1/38
11,125,533 B1 * 9/2021 Holland ..... G02B 25/001
11,302,041 B2 * 4/2022 Hoffman ..... F41G 1/38
12,025,469 B2 * 7/2024 Ding ..... F41G 1/38
2005/0257414 A1 * 11/2005 Zaderey ..... F41G 1/44 42/122
2014/0166751 A1 * 6/2014 Sammut ..... F41G 3/12 235/404
2014/0319216 A1 * 10/2014 Meinert ..... F41G 1/18 235/404
2015/0253132 A1 * 9/2015 Senne ..... G01C 3/04 356/21
2017/0138698 A1 * 5/2017 York ..... F41G 1/44
2022/0113117 A1 * 4/2022 Hamilton ..... F41G 3/08
2022/0148450 A1 * 5/2022 Brooks ..... F41J 9/02
2023/0221094 A1 * 7/2023 Yan ..... F41G 1/467 124/87
2023/0288171 A1 * 9/2023 Mikroulis ..... F41G 1/473
(Continued)

*Primary Examiner* — George B Bennett

(57) ABSTRACT

The present disclosure provides a sight capable of switching reticles, a method and a device. The sight capable of switching reticles includes an objective lens component, an image acquisition device, a display device, a controller and an eyepiece component. The objective lens component is configured to acquire and image an external light source. The image acquisition device is configured to acquire an image formed by the objective lens component and generate image data. The display device is configured to display the image and the reticles. The controller is electrically connected to the image acquisition device and the display device. The eyepiece component is arranged at a second end of the optical channel, and the eyepiece component is configured to magnify the formed image on the display device.

18 Claims, 12 Drawing Sheets

(56) References Cited

U.S. PATENT DOCUMENTS

| | | | | |
|---|---|---|---|---|
| 2024/0159502 | A1* | 5/2024 | Grinwald | F41G 3/06 |
| 2024/0200902 | A1* | 6/2024 | Iwanami | F41G 1/38 |

* cited by examiner

SIGHT CAPABLE OF SWITCHING RETICLES, METHOD, AND DEVICE

TECHNICAL FIELD

The present disclosure relates to the technical field of aiming devices, and in particular, to a sight capable of switching reticles, a method, and a device.

BACKGROUND

As a kind of aiming device, sights are widely used in firearms, crossbows, and other facilities. The sights are mainly divided into following three categories: a telescopic sight, a collimating sight, and a reflective sight. A main function of a sight is to facilitate users to observe distant places and aim at targets.

A user usually aims at a target, estimate a target distance, calculate a falling speed of a bullet, and adjust a wind deflection through reticles on a sight. Commonly used sights are divided into First Focus Plane) FFP sights and Second Focus Plane (SFP) sights according to a difference in focal planes where the reticles are located. When the FFP sight is zoomed, the reticles will change with magnifications. The advantage of this type of sight is that the function of the reticles can be used at all magnifications, and the disadvantage is that the reticles will become very small at low magnifications, and it is very hard to see the reticles clearly especially under strong light. This type of sight is more suitable at high magnifications. The reticles will not change when the SFP sight is zoomed, so that a size of the reticles is moderate during use. The reticles can be clearly observed at any magnification, and this type of sight is more suitable at low magnifications. The sights on the market are generally the FFP sights or the SFP sights, and there is no sight that can have the two reticule forms and have the advantages of both the sights.

For this purpose, the present disclosure provides a sight capable of switching reticles, which can effectively solve the above problems. The sight can choose to switch a display mode of the reticles according to an operation of a user, and can be switched between the FFP sight and the SFP sight at any time, so that the user can make a choice freely according to a need, and it is convenient for the user to use the sight to aim at a target, estimate a target distance, calculate a falling speed of a bullet, adjust a wind deflection, and the like.

SUMMARY

In order to overcome the shortcomings of the prior art, the present disclosure provides a sight capable of switching reticles, which can be switched between the FFP sight and the SFP sight freely, and it is convenient for the user to use the sight to aim at a target, estimate a target distance, calculate a falling speed of a bullet, adjust a wind deflection, and the like.

The technical solution adopted by the present disclosure to solve the technical problem is as follows.

A sight capable of switching reticles, including:

an objective lens component, wherein the objective lens component is arranged at a first end of an optical channel, and the objective lens component is configured to acquire and image an external light source;

an image acquisition device, wherein the image acquisition device is arranged on one side of the optical channel close to the objective lens component, and the image acquisition device is configured to acquire an image formed by the objective lens component and generate image data;

a display device, wherein the display device is arranged on one side of the optical channel away from the objective lens component, and the display device is configured to display the image and the reticles;

a controller, wherein the controller is electrically connected to the image acquisition device and the display device, and the controller is configured to acquire the image data and transmit the image data to the display device; and the controller receives a reticule instruction and adjusts a size of the reticles according to the reticule instruction; and an eyepiece component, wherein the eyepiece component is arranged at a second end of the optical channel, and the eyepiece component is configured to magnify the formed image on the display device.

As the improvement of the present disclosure, the reticles include a first reticule and a second reticule, and the controller receives the reticule instruction and displays the first reticule or the second reticule according to the instruction.

As the improvement of the present disclosure, a size and magnification of the first reticule change synchronously.

As the improvement of the present disclosure, the first reticule includes a first-unit first reticule and a second-unit first reticule; and the controller receives the reticule instruction and displays the first-unit first reticule or the second-unit first reticule according to the instruction.

As the improvement of the present disclosure, a size of the second reticule is fixed.

As the improvement of the present disclosure, the second reticule includes a first-unit second reticule and a second-unit second reticule; and the controller receives the reticule instruction and displays the first-unit second reticule or the second-unit second reticule according to the instruction.

The present disclosure also provides a method for switching reticles of a sight, including:

acquiring image data generated by an image acquisition device according to an image formed by an objective lens component;

transmitting the image data to a display device, and form an image on the display device to allow the image to be observed through the objective lens component; and receiving a reticule instruction, adjusting a size of the reticles according to the reticule instruction, and controlling the display device to display the reticles.

As the improvement of the present disclosure, the reticles include a first reticule and a second reticule, and the controller receives the reticule instruction and displays the first reticule or the second reticule according to the instruction.

As the improvement of the present disclosure, a size and magnification of the first reticule change synchronously.

As the improvement of the present disclosure, the first reticule includes a first-unit first reticule and a second-unit first reticule; and the controller receives the reticule instruction and displays the first-unit first reticule or the second-unit first reticule according to the instruction.

As the improvement of the present disclosure, a size of the second reticule is fixed.

As the improvement of the present disclosure, the second reticule includes a first-unit second reticule and a second-unit second reticule; and the controller receives the reticule instruction and displays the first-unit second reticule or the second-unit second reticule according to the instruction.

The present disclosure also provides a device for switching reticles of a sight, including:

an image acquisition unit, wherein the image acquisition unit is configured to acquire an image formed by an objective lens component and generate image data;

a display unit, wherein the display unit is configured to receive the image data and display an image and the reticles; and a control unit, wherein the control unit is electrically connected to the image acquisition unit and the display unit, and the control unit is configured to acquire the image data and transmit the image data to the display unit; and the control unit is further configured to receive a reticule instruction and adjust a size of the reticles according to the reticule instruction.

As the improvement of the present disclosure, the reticles include a first reticule and a second reticule, and the control unit receives the reticule instruction and controls, according to the instruction, the display unit to display the first reticule or the second reticule.

As the improvement of the present disclosure, a size and magnification of the first reticule change synchronously.

As the improvement of the present disclosure, the first reticule includes a first-unit first reticule and a second-unit first reticule; and the control unit receives the reticule instruction and controls, according to the instruction, the display unit to display the first-unit first reticule or the second-unit first reticule.

As the improvement of the present disclosure, a size of the second reticule is fixed.

As the improvement of the present disclosure, the second reticule includes a first-unit second reticule and a second-unit second reticule; and the control unit receives the reticule instruction and controls, according to the instruction, the display unit to display the first-unit second reticule or the second-unit second reticule.

Beneficial effects of the present disclosure are as follows: By the arrangement of the above structure, the objective lens component can acquire and image the external light source during use. The objective lens component is generally a group of coaxial lenses. The image acquisition device is arranged on one side of the optical channel close to the objective lens component, and can acquire the image formed by the objective lens component and convert the image into an electronic signal. The image acquisition device is generally a camera or an image sensor, and is arranged on an optical axis of a lens of the objective lens component. Preferably, the image acquisition device is arranged at a focal plane of the objective lens component, so as to acquire images formed by the objective lens component more efficiently. The display device receives the image data and displays the image and the reticles. Moreover, the display device is usually arranged on the optical axis where a lens of the eyepiece component is located, preferably on a focal plane of the eyepiece component, so as to facilitate a user to observe the images and reticles on the display device through the eyepiece component. The display device is generally a screen. The controller is electrically connected to the image acquisition device and the display device. The controller receives a signal generated by the image acquisition device and transmits the signal to the display device. At the same time, the controller can receive an instruction of the user to display the reticles on a display screen and adjust a size of the reticles. Specifically, the controller can adjust a display form of the reticles to switch the sight to an FFP sight or an SFP sight.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
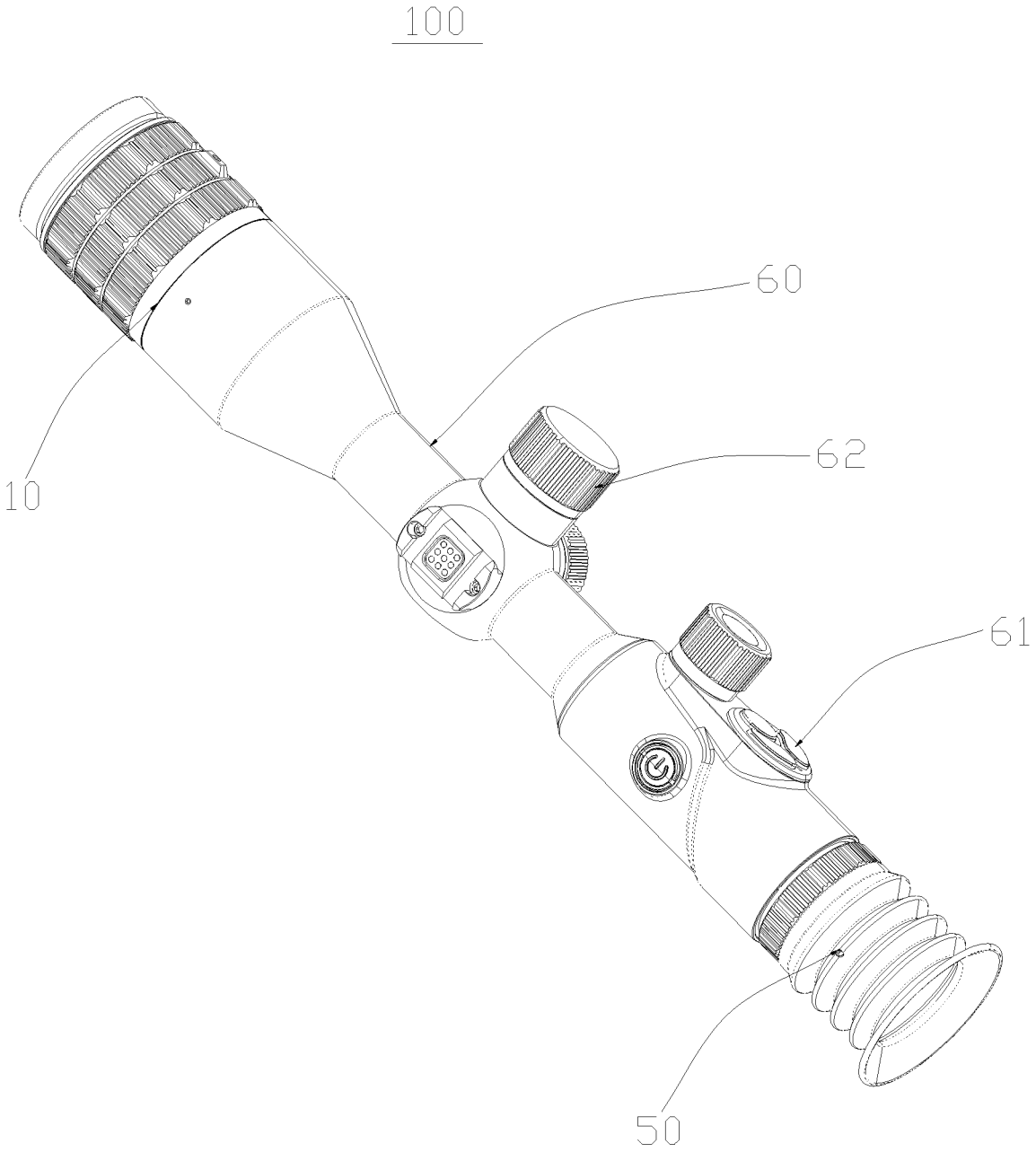
FIG. 1 is a schematic diagram of an entire structure of a sight according to the present disclosure.
Figure 2:
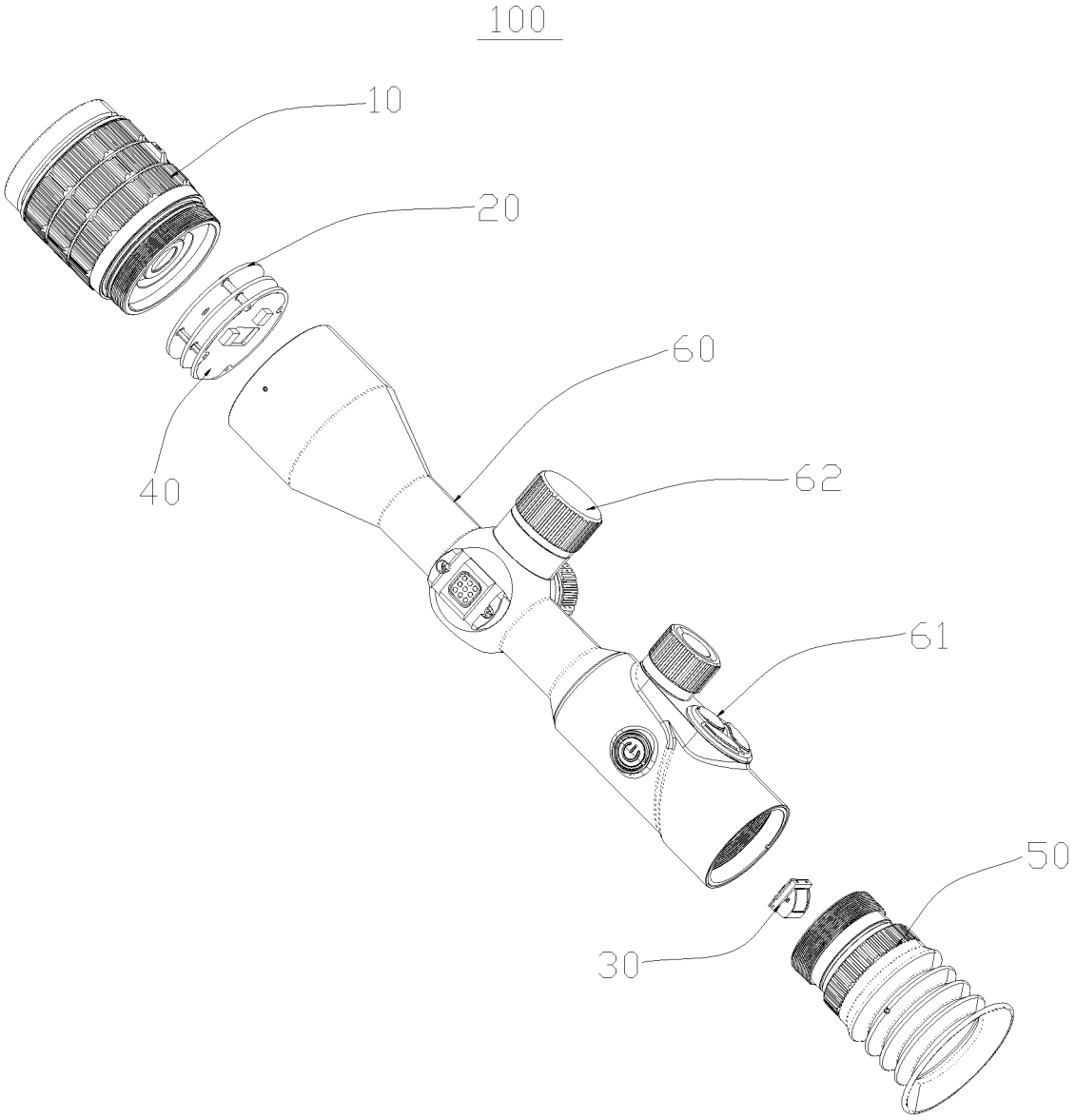
FIG. 2 is a structural exploded diagram of a sight according to the present disclosure.
Figure 3:
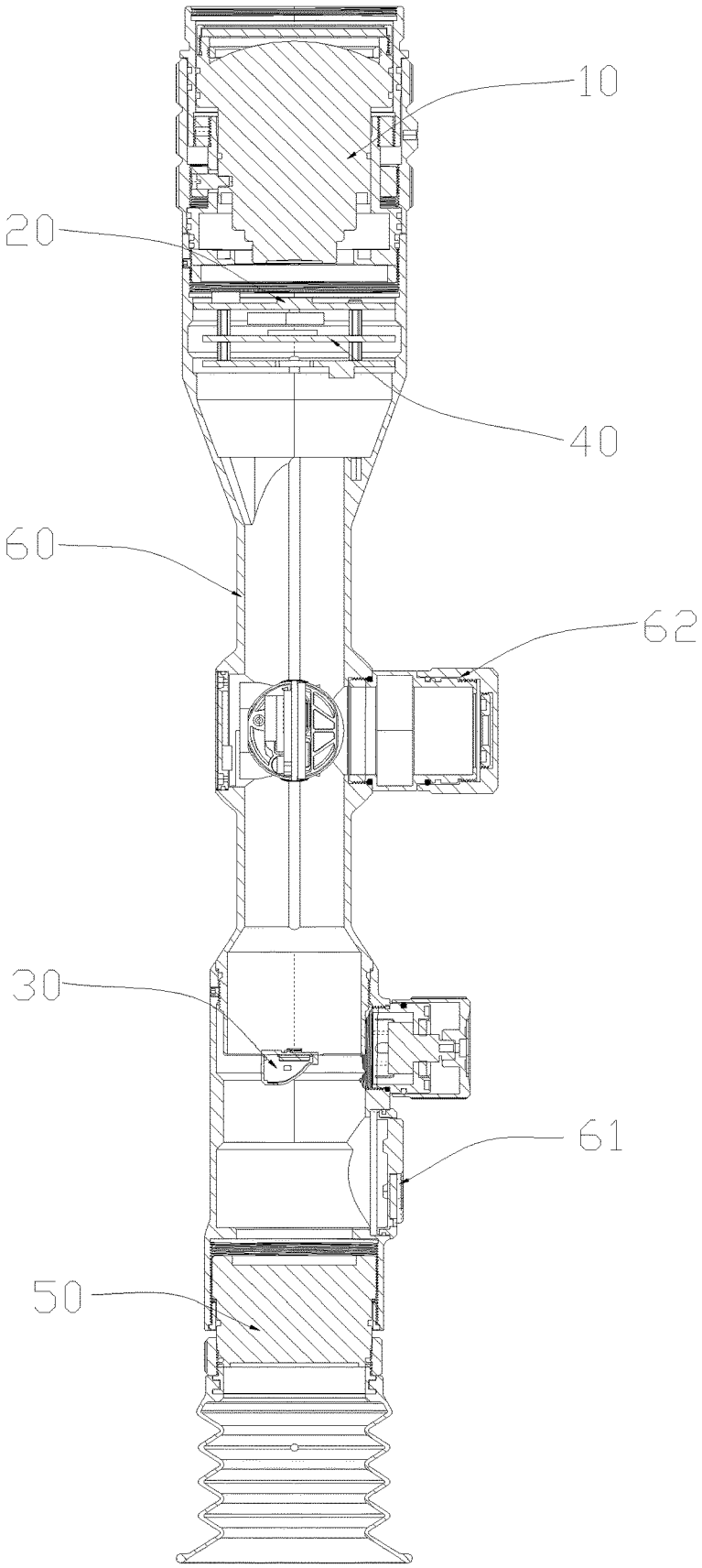
FIG. 3 is a schematic diagram of a sectional structure of a sight according to the present disclosure.
Figure 4:
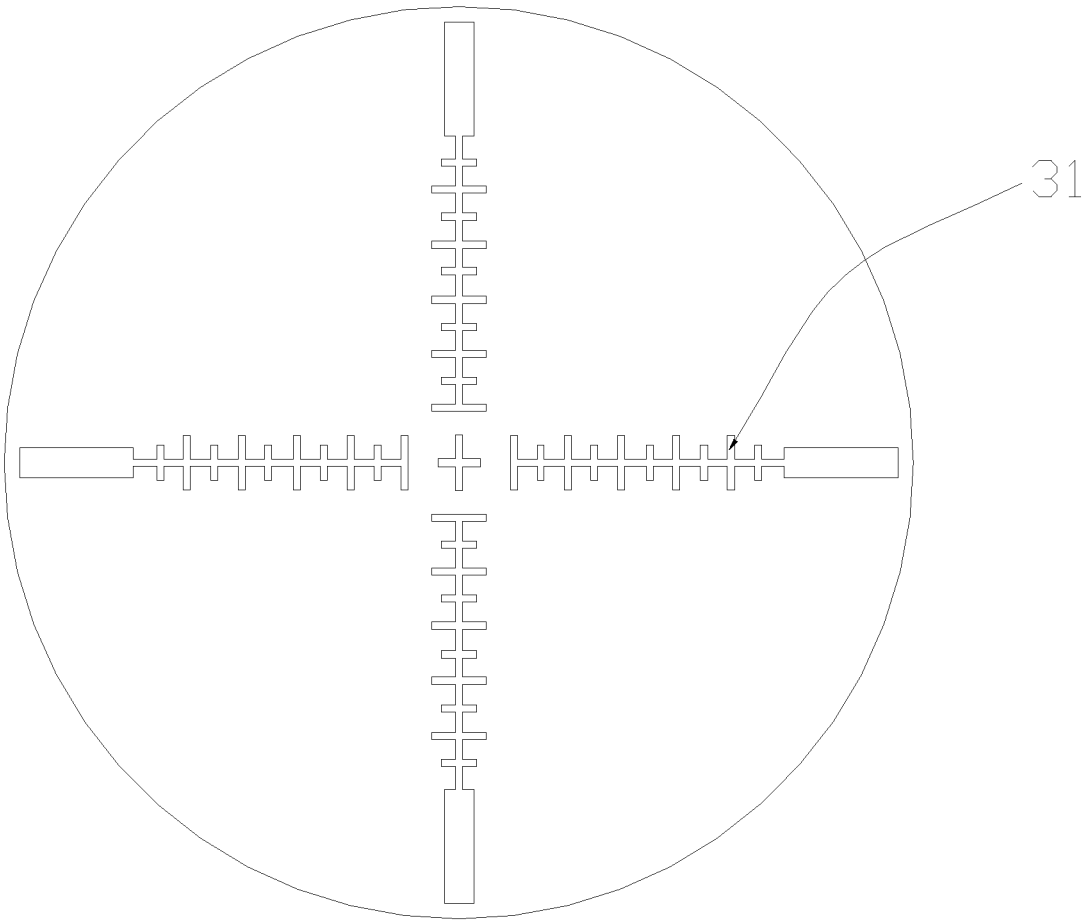
FIG. 4 is a view of observation through an eyepiece of a sight according to the present disclosure.
Figure 5A:
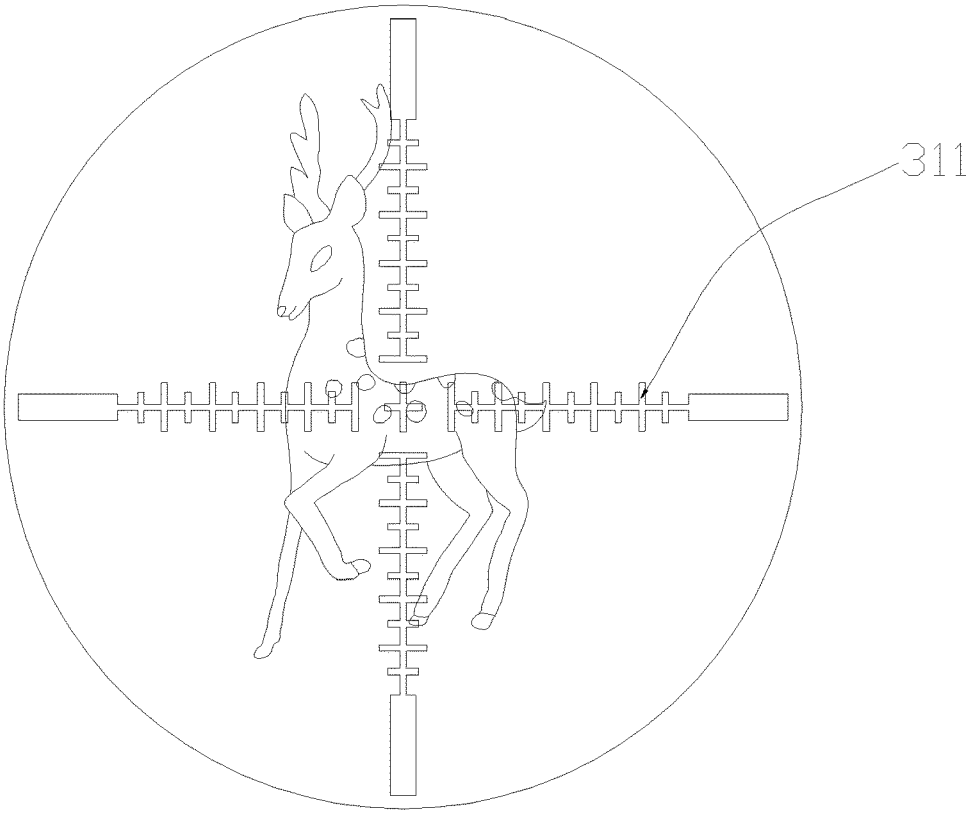
FIG. 5A is a view when a first reticule is observed through an eyepiece of a sight according to the present disclosure at a first magnification.
Figure 5B:
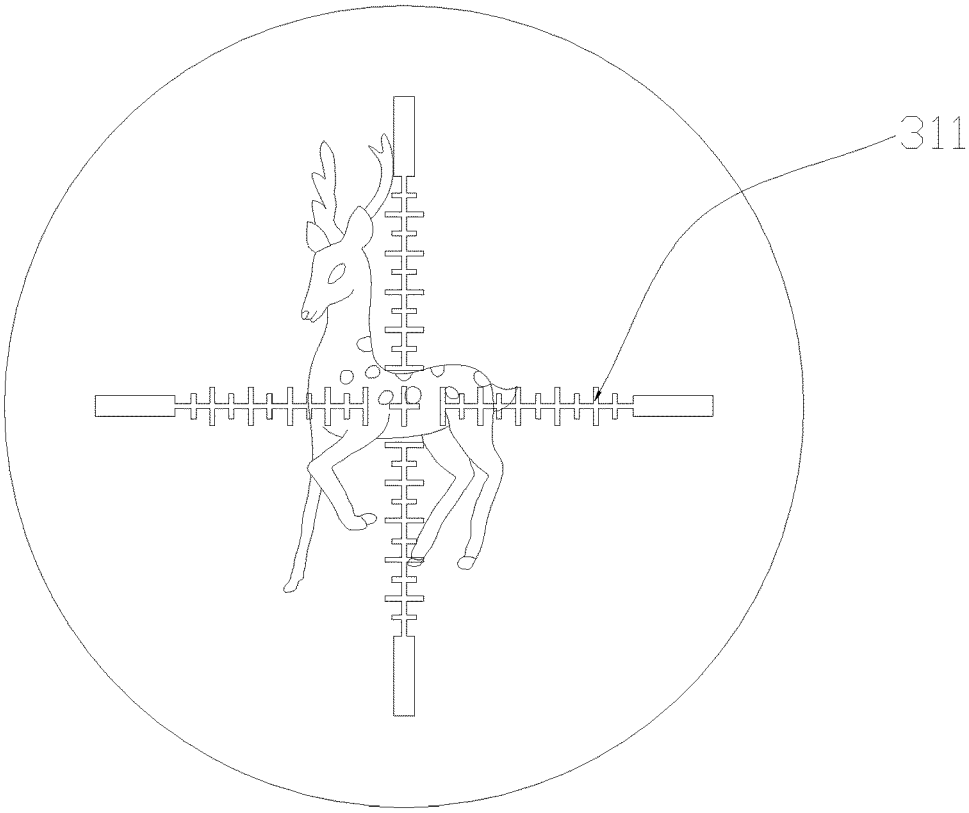
FIG. 5B is a view when a first reticule is observed through an eyepiece of a sight according to the present disclosure at a second magnification.
Figure 5C:
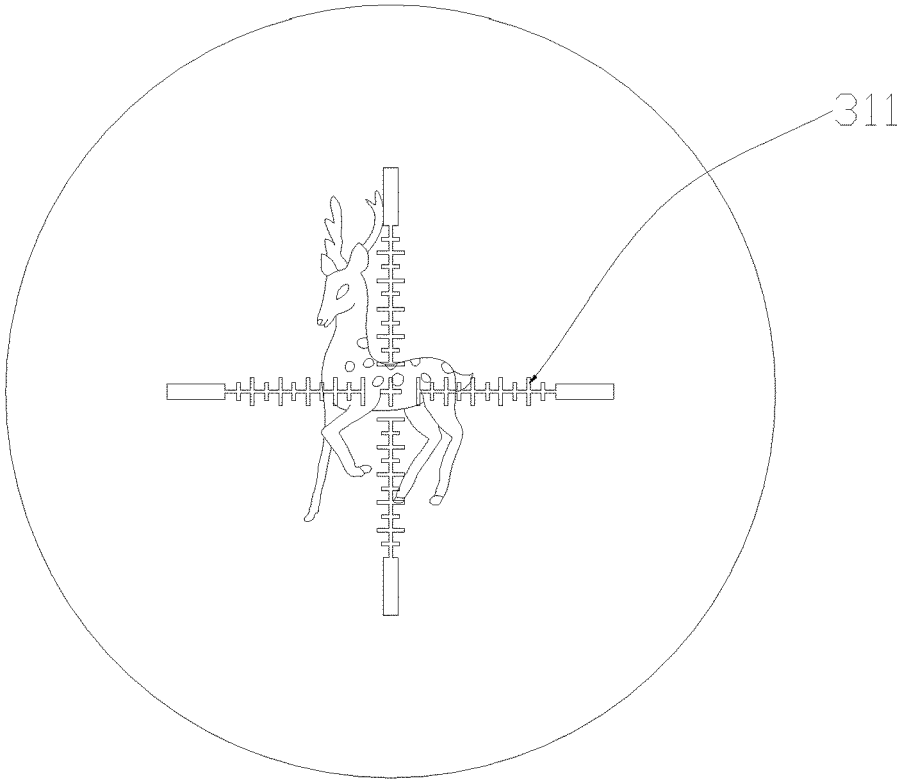
FIG. 5C is a view when a first reticule is observed through an eyepiece of a sight according to the present disclosure at a third magnification.
Figure 5D:
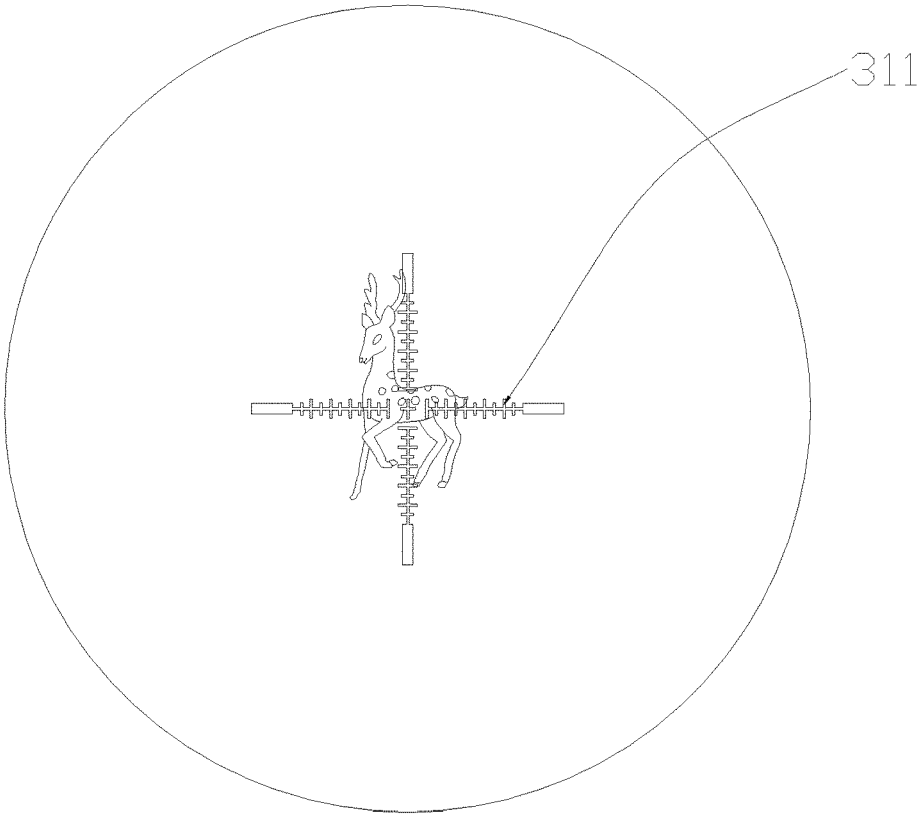
FIG. 5D is a view when a first reticule is observed through an eyepiece of a sight according to the present disclosure at a fourth magnification.
Figure 6A:
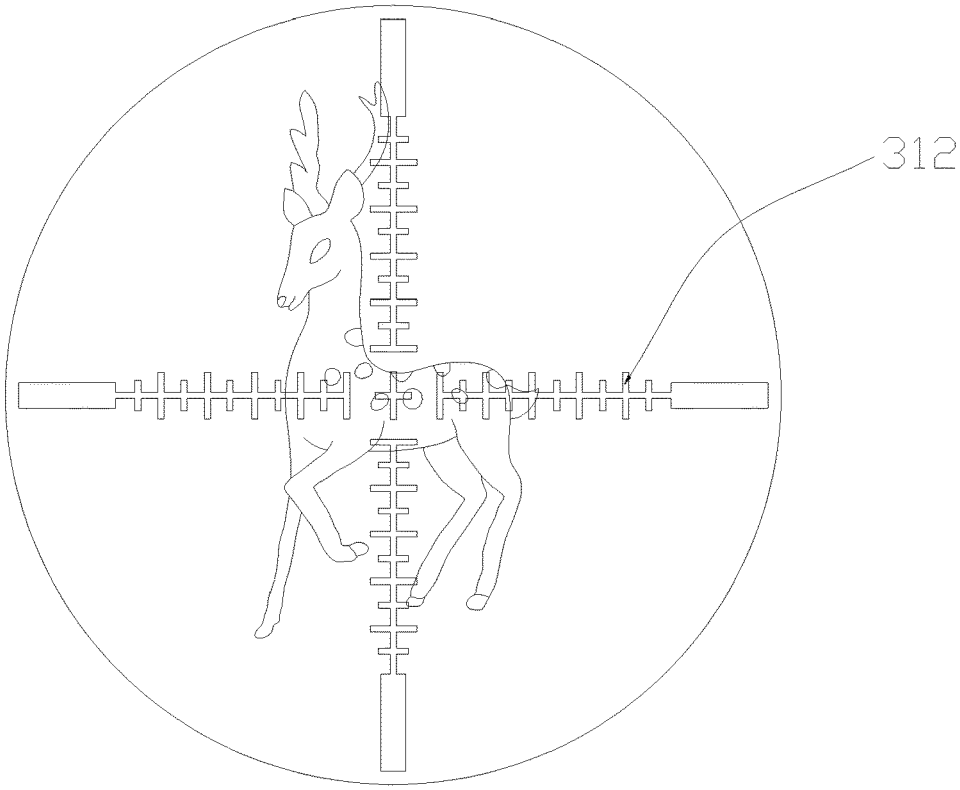
FIG. 6A is a view when a second reticule is observed through an eyepiece of a sight according to the present disclosure at a first magnification.
Figure 6B:
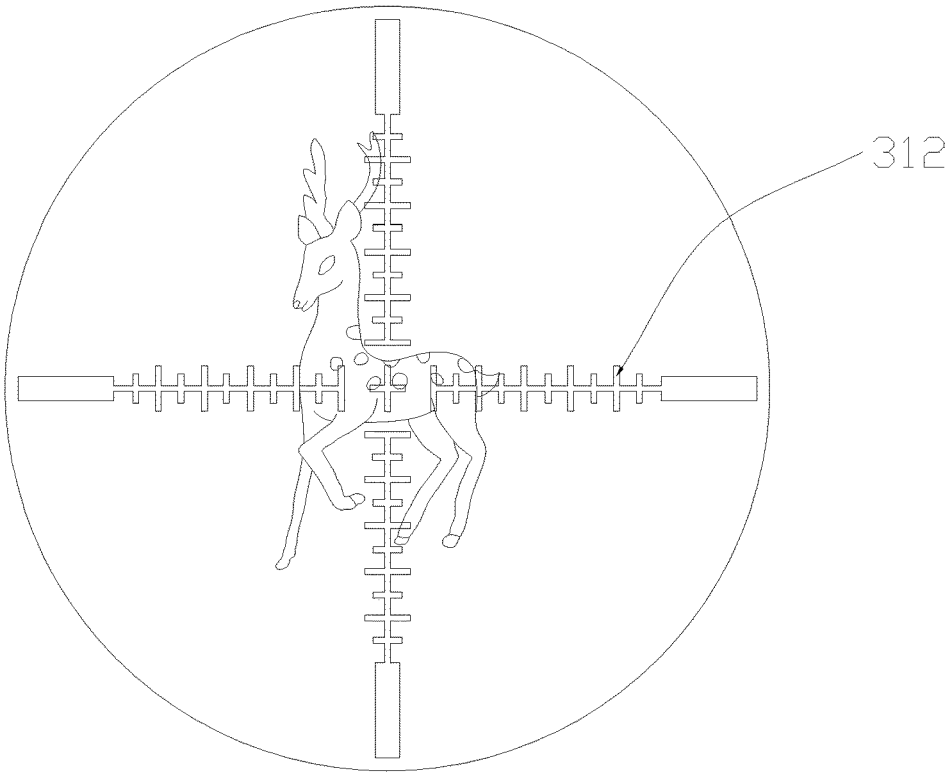
FIG. 6B is a view when a second reticule is observed through an eyepiece of a sight according to the present disclosure at a second magnification.
Figure 6C:
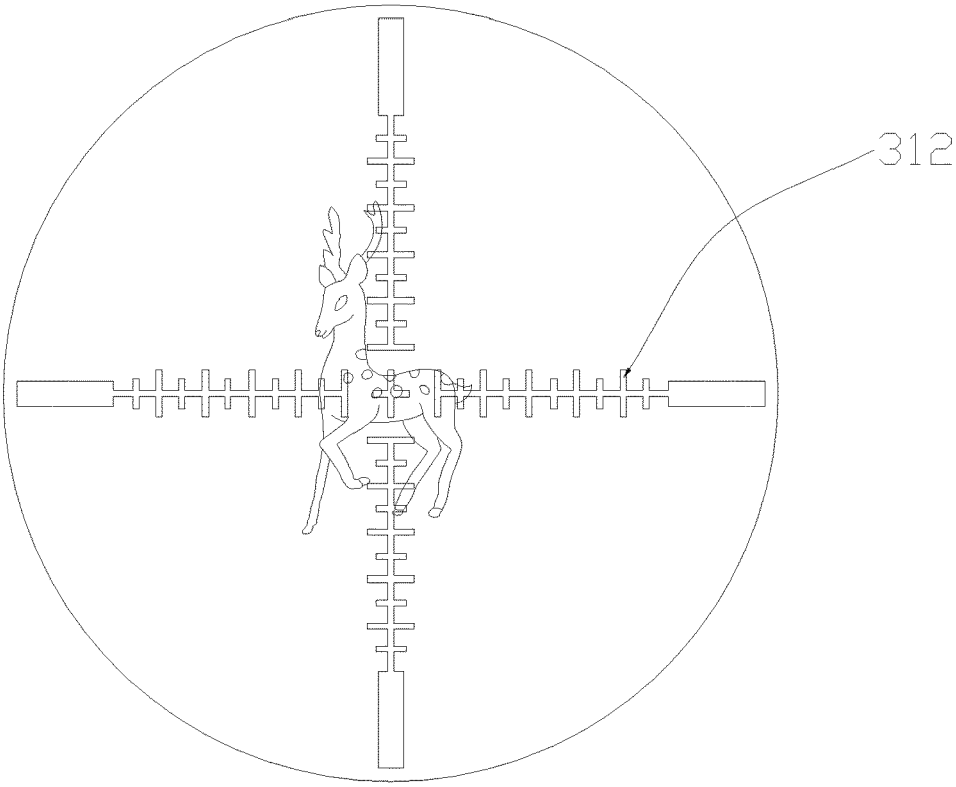
FIG. 6C is a view when a second reticule is observed through an eyepiece of a sight according to the present disclosure at a third magnification.
Figure 6D:
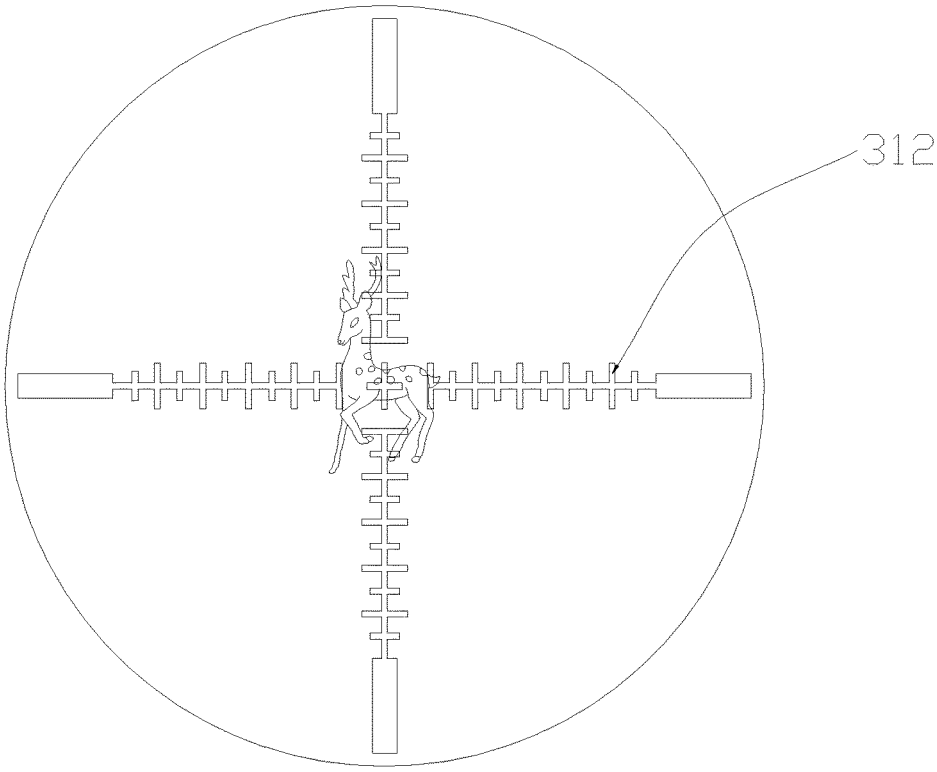
FIG. 6D is a view when a second reticule is observed through an eyepiece of a sight according to the present disclosure at a fourth magnification.

Referring to FIG. 1 to FIG. 8, a sight 100 capable of switching reticles includes:

an objective lens component 10, wherein the objective lens component 10 is arranged at a first end of an optical channel, and the objective lens component 10 is configured to acquire and image an external light source;

an image acquisition device 20, wherein the image acquisition device 20 is arranged on one side of the optical channel close to the objective lens component 10, and the image acquisition device 20 is configured to acquire an image formed by the objective lens component 10 and generate image data;

a display device 30, wherein the display device 30 is arranged on one side of the optical channel away from the objective lens component 10, and the display device 30 is configured to display the image and the reticles 31;

a controller 40, wherein the controller 40 is electrically connected to the image acquisition device 20 and the display device 30, and the controller 40 is configured to acquire the image data and transmit the image data to the display device 30; and the controller 40 receives a reticule instruction and adjusts a size of the reticles 31 according to the reticule instruction; and an eyepiece component 50, wherein the eyepiece component 50 is arranged at a second end of the optical channel, and the eyepiece component 50 is configured to magnify the formed image on the display device 30.

By the arrangement of the above structure, the objective lens component can acquire and image the external light source during use. The objective lens component is generally a group of coaxial lenses. The image acquisition device is arranged on one side of the optical channel close to the objective lens component, and can acquire the image formed by the objective lens component and convert the image into an electronic signal. The image acquisition device is generally a camera or an image sensor, and is arranged on an optical axis of a lens of the objective lens component. Preferably, the image acquisition device is arranged at a focal plane of the objective lens component, so as to acquire images formed by the objective lens component more efficiently. The display device receives the image data and displays the image and the reticles. Moreover, the display device is usually arranged on the optical axis where a lens of the eyepiece component is located, preferably on a focal plane of the eyepiece component, so as to facilitate a user to observe the images and reticles on the display device through the eyepiece component. The display device is generally a screen. The controller is electrically connected to the image acquisition device and the display device. The controller receives a signal generated by the image acquisition device and transmits the signal to the display device. At the same time, the controller can receive an instruction of the user to display the reticles on a display screen and adjust a size of the reticles. Specifically, the controller can adjust a display form of the reticles to switch the sight to an FFP sight or an SFP sight. Moreover, the objective lens component, the image acquisition device, the controller, the display device, and the eyepiece component are all arranged inside a housing 60.

Specifically, the controller can form reticles in the middle of the display device according to a resolution and pixel size of a display, so that the reticles basically fully covers a display surface of the display device to form the SFP sight. Furthermore, to switch the sight to the FFP sight, based on a relationship of Mimute of Angle (1MOA)=1.047 inches at a distance of 100 yards from the target, the controller maps the 1.047 inches proportionally to the image acquisition device according to the resolution and pixel of the image acquisition device and calculates lengths of the reticles on the image acquisition device. The controller then calculates, according to ratios of a resolution and pixel of the display device to a resolution and pixel of the image acquisition device, a quantity of pixel points occupied by the reticles on the screen, and finally form the reticles on the display device. Based on this, during switching of magnifications, effective pixels of the image acquisition device will decrease. The reticles will be proportionally zoom in or zoom out the reticles according to a ratio of the effective pixels after magnification switching, so as to achieve the function of the FFP sight.

In this embodiment, the reticles 31 include a first reticule 311 and a second reticule 312, and the controller 40 receives the reticule instruction and displays the first reticule 311 or the second reticule 312 according to the instruction. Specifically, referring to FIG. 1 to FIG. 3, a button 61 is arranged on a surface of the housing 60. The user can input an instruction through the button, and the controller receives the instruction and displays the first reticule or the second reticule on the display according to the instruction. The sight is switched to the FFP sight or the SFP sight, which can allow the user to select sights of different forms in different usage scenarios.

In this embodiment, the size and magnification of the first reticule 311 change synchronously. Referring to FIG. 5A to FIG. 5D, when a magnification changes, a size of a reticule changes synchronously with the magnification. Specifically, during switching of the magnification, for example, during switching from a low magnification to a high magnification, effective pixels of the image acquisition device will decrease. At this time, the reticule will be proportionally zoomed in, and an image change observed through the eyepiece component is like switching from an image in FIG. 5D to an image in FIG. 5A.

Figure 7A:
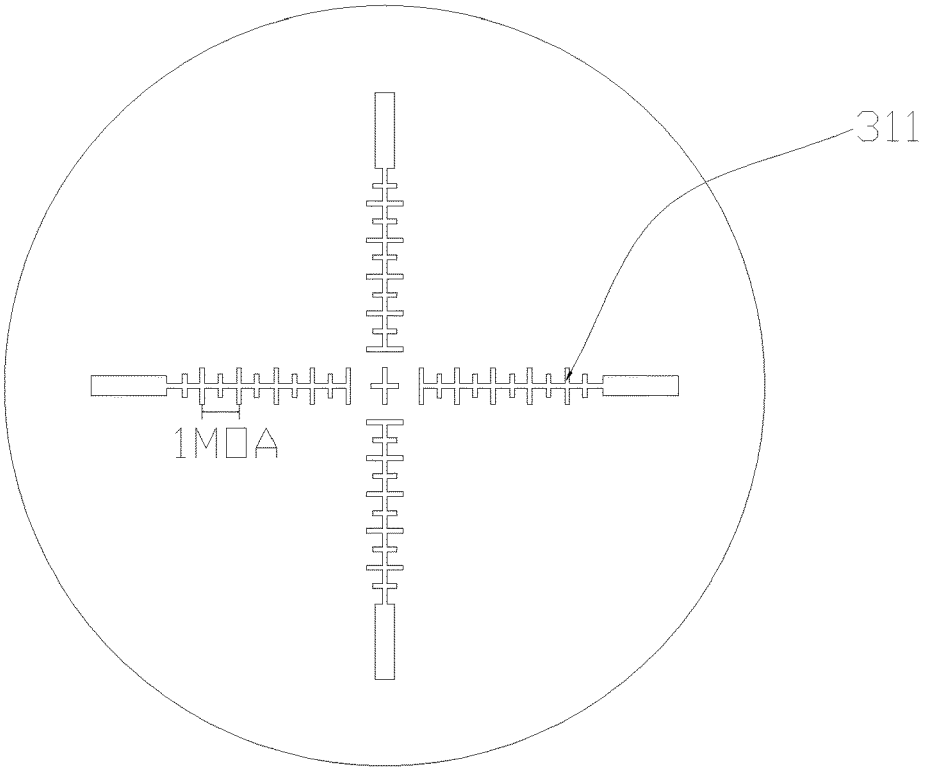
FIG. 7A is a view when a first reticule is observed through an eyepiece of a sight according to the present disclosure at a first unit.
Figure 7B:
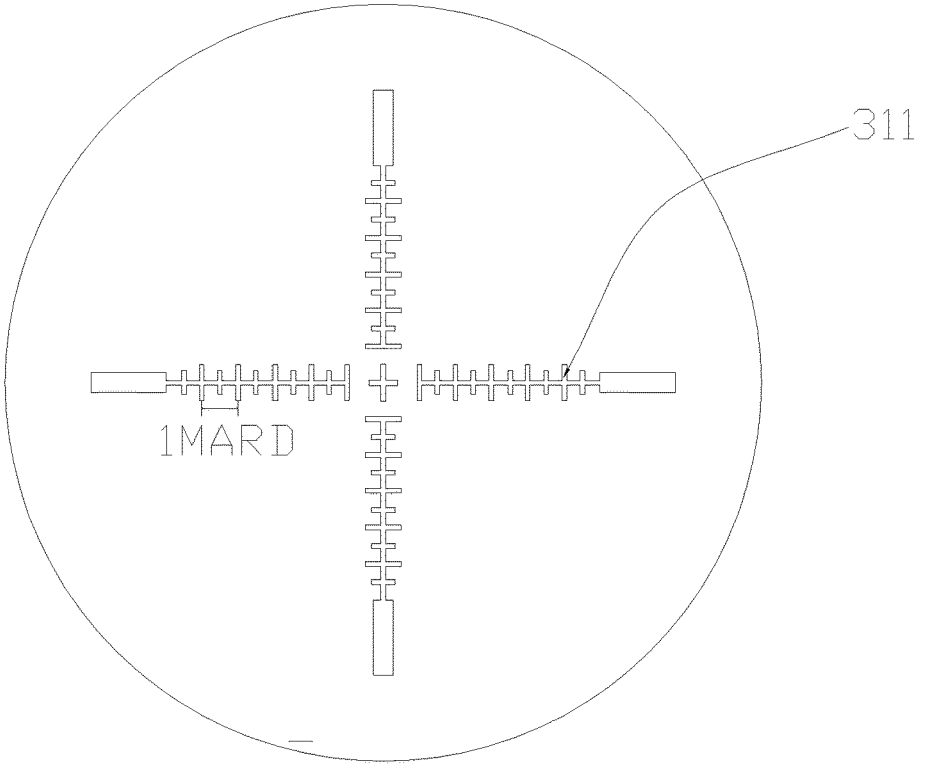
FIG. 7B is a view when a first reticule is observed through an eyepiece of a sight according to the present disclosure at a second unit.

In this embodiment, the first reticule 311 includes a first-unit first reticule and a second-unit first reticule; and the controller 40 receives the reticule instruction and displays the first-unit first reticule or the second-unit first reticule according to the instruction. The sight generally uses a metric unit or an imperial unit. The size of a specific reticule on the sight will be changed correspondingly. As shown in FIG. 7A to FIG. 7B, according to different length units, a previous switching ratio is 3.43, namely, 1MOA=3.43 Mard. A user can switch the unit of the first reticule by touching the button 61 on the surface of the housing 60, so that users with different habits for using a sight can use the sight product more conveniently.

In this embodiment, a size of the second reticule 312 is fixed. Referring to FIG. 6A to FIG. 6D, the second reticule is similar to a reticule of the SFP sight. When the magnification of the sight is switched, a size of an observed image changes, but the size of the second reticule does not change.

Figure 8A:
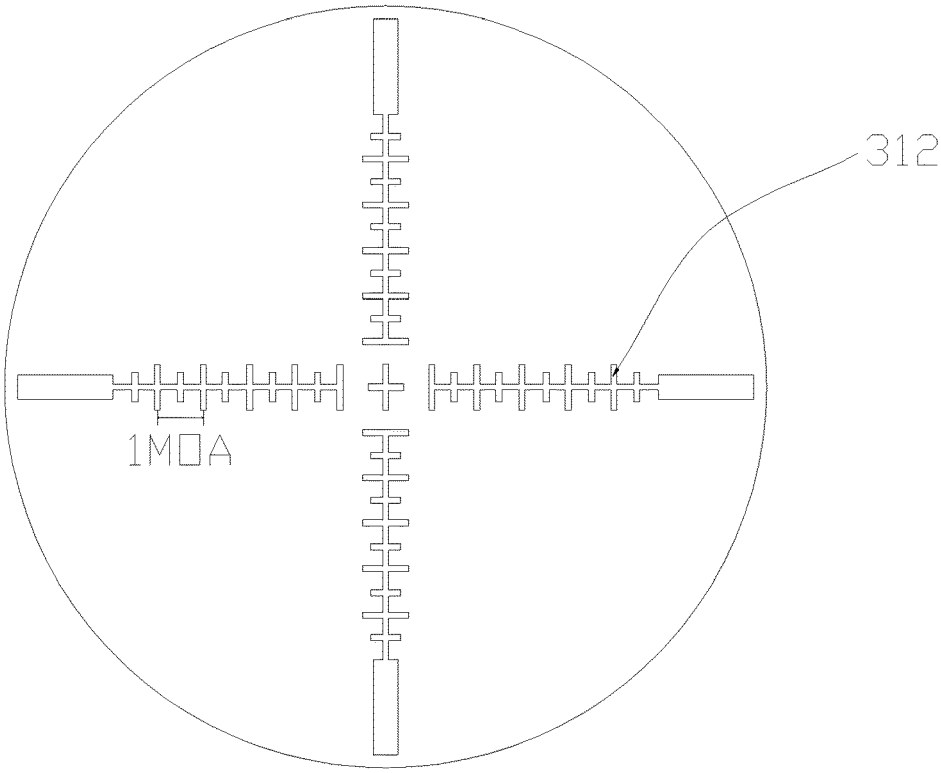
FIG. 8A is a view when a second reticule is observed through an eyepiece of a sight according to the present disclosure at a first unit.
Figure 8B:
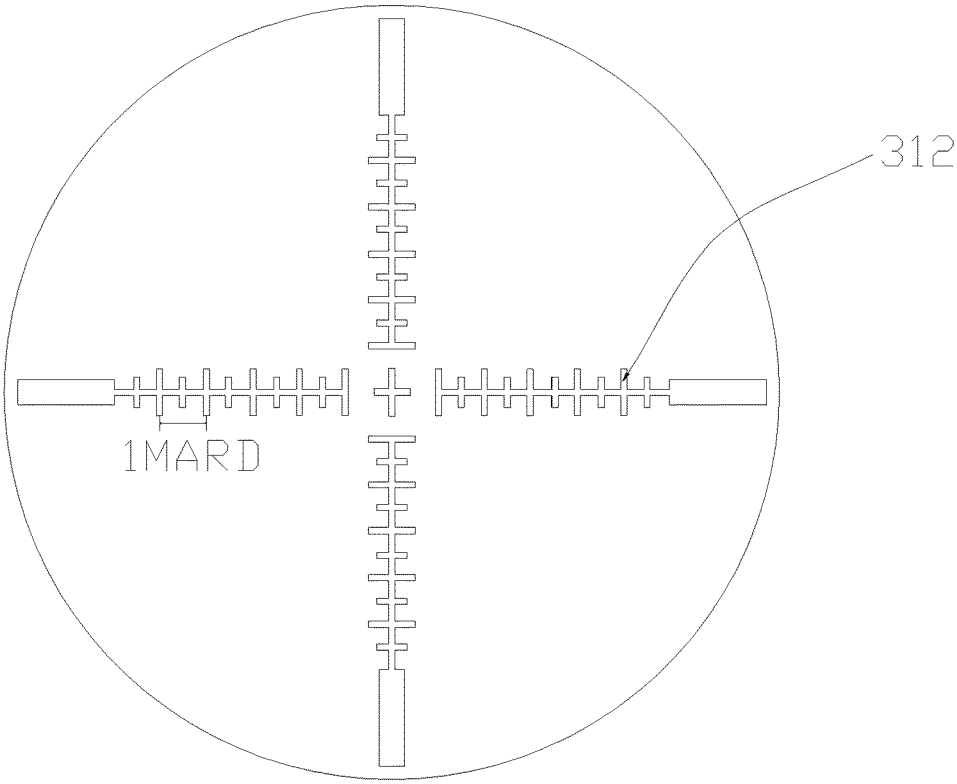
FIG. 8B is a view when a second reticule is observed through an eyepiece of a sight according to the present disclosure at a second unit.

In this embodiment, the second reticule 312 includes a first-unit second reticule and a second-unit second reticule; and the controller 40 receives the reticule instruction and displays the first-unit second reticule or the second-unit second reticule according to the instruction. As shown in FIG. 8A to FIG. 8B, the user can switch the unit of the second reticule by touching the button 61 on the surface of the housing 60, so that users with different habits for using a sight can use the sight product more conveniently.

The sight further includes an adjustment knob 62. The adjustment knob is arranged on a surface of the housing 60. The adjustment knob is configured to move an objective lens of the objective lens component 10 along an optical axis direction to adjust a focal length of the objective lens component.

Figure 9:
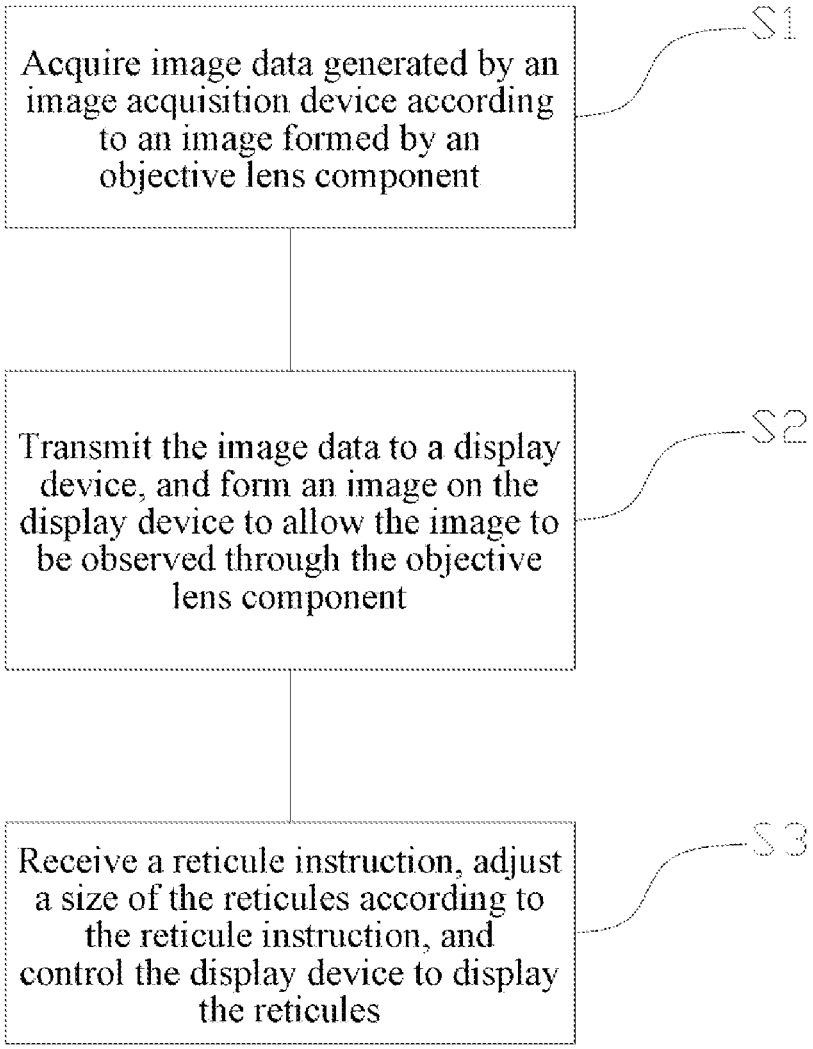
FIG. 9 is a flowchart of a method according to the present disclosure.

Referring to FIG. 9, a method for switching reticles of a sight is provided, including:

step S1, acquiring image data generated by an image acquisition device according to an image formed by an objective lens component;

step S2, transmitting the image data to a display device 30, and form an image on the display device to allow the image to be observed through the objective lens component; and step S3, receiving a reticule instruction, adjusting a size of the reticles according to the reticule instruction, and controlling the display device to display the reticles.

By the arrangement of the above structure, during use, the image data acquired by the image acquisition device is acquired, and the image data is transmitted to the display device and displayed on the display device. The image acquisition device acquires the image formed by the objective lens component. The instruction is received, and the size of the reticles is adjusted according to the instruction. The reticles are displayed on the display device. It can be convenient for a user to switch the form of the reticles, and the sight can be switched to an FFP sight or an SFP sight. Customers with different usage habits and different usage needs can use the sight conveniently and efficiently.

In this embodiment, the reticles 31 include a first reticule 311 and a second reticule 312, and the controller 40 receives the reticule instruction and displays the first reticule 311 or the second reticule 312 according to the instruction. Preferably, referring to FIG. 1 to FIG. 3, human-computer interactions can be achieved through a button 61 on a surface of a housing 60. The instruction is acquired, and the display device is controlled according to the instruction to display the first reticule or the second reticule. The sight is switched to the FFP sight or the SFP sight, which can allow the user to select sights of different forms in different usage scenarios.

In this embodiment, the size and magnification of the first reticule 311 change synchronously. Referring to FIG. 5A to FIG. 5D, when a magnification changes, a size of a reticule changes synchronously with the magnification. Specifically, during switching of the magnification, for example, during switching from a low magnification to a high magnification, effective pixels of the image acquisition device will decrease. The size of the first reticule is adjusted to be proportionally zoomed in, and an image change observed through the eyepiece component is like switching from an image in FIG. 5D to an image in FIG. 5A.

In this embodiment, the first reticule 311 includes a first-unit first reticule and a second-unit first reticule; and the controller 40 receives the reticule instruction and displays the first-unit first reticule or the second-unit first reticule according to the instruction. During unit switching, the user inputs an instruction through the button 61, and the controller switches a unit of the first reticule according to the instruction. According to different length units, a switching ratio of the first-unit first reticule to the second-unit first reticule is 3.43, namely, 1MOA=3.43 Mard. The user can perform switching to the first-unit first reticule or the second-unit first reticule by touching the button 61 on the surface of the housing 60, and users with different habits for using a sight can use the sight product more conveniently.

In this embodiment, a size of the second reticule 312 is fixed.

In this embodiment, the second reticule 312 includes a first-unit second reticule and a second-unit second reticule; and the controller 40 receives the reticule instruction and displays the first-unit second reticule or the second-unit second reticule according to the instruction. As shown in FIG. 8A to FIG. 8B, the user can input an instruction by touching the button 61 on the surface of the housing 60, and the controller switches the unit of the second reticule according to the instruction, so that users with different habits for using a sight can use the sight product more conveniently.

Figure 10:
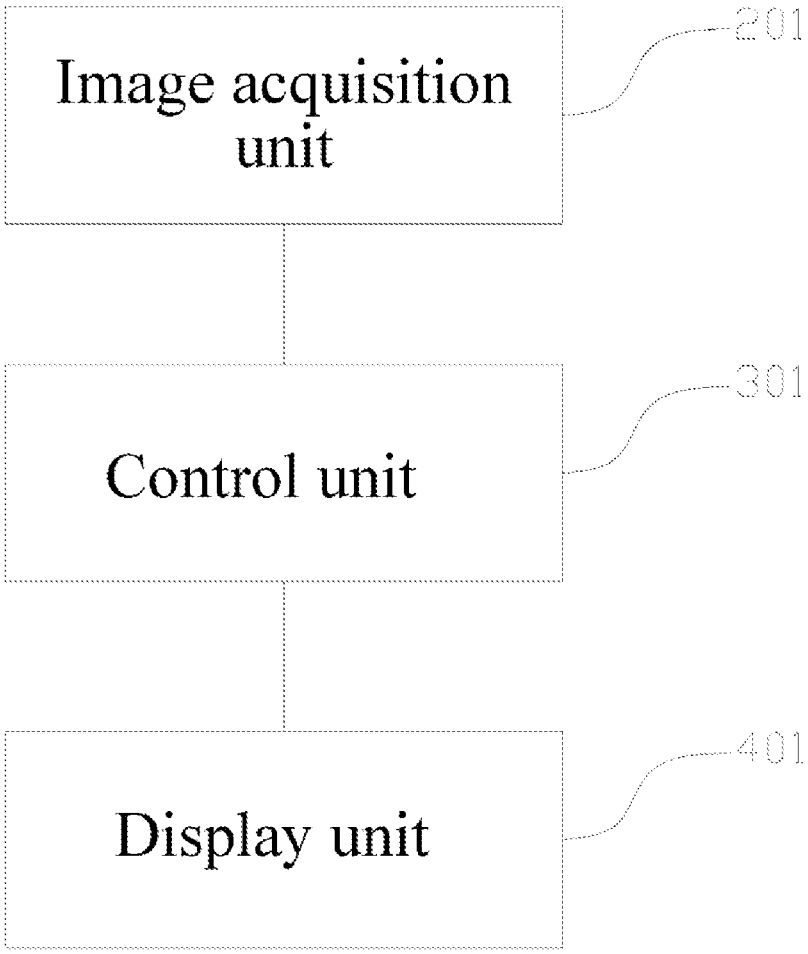
FIG. 10 is a schematic diagram of module structures according to the present disclosure.

Referring to FIG. 10, a device for switching reticles of a sight is provided, including:

an image acquisition unit 201, wherein the image acquisition unit 201 is configured to acquire an image formed by an objective lens component and generate image data;

a display unit 301, wherein the display unit 301 is configured to receive the image data and display an image and the reticles; and a control unit 401, wherein the control unit 401 is electrically connected to the image acquisition unit 201 and the display unit 301, and the control unit 401 is configured to acquire the image data and transmit the image data to the display unit 301; and the control unit 401 is further configured to receive a reticule instruction and adjust a size of the reticles according to the reticule instruction.

In this embodiment, the reticles 31 include a first reticule 311 and a second reticule 312, and the control unit 401 receives the reticule instruction and controls, according to the instruction, the display unit 301 to display the first reticule 311 or the second reticule 312.

In this embodiment, the size and magnification of the first reticule 311 change synchronously.

In this embodiment, the first reticule 311 includes a first-unit first reticule and a second-unit first reticule; and the control unit 401 receives the reticule instruction and controls, according to the instruction, the display unit 301 to display the first-unit first reticule or the second-unit first reticule.

In this embodiment, a size of the second reticule 312 is fixed.

In this embodiment, the second reticule 312 includes a first-unit second reticule and a second-unit second reticule; and the control unit 401 receives the reticule instruction and controls, according to the instruction, the display unit 301 to display the first-unit second reticule or the second-unit second reticule.

Specific implementations of the device for switching the reticles of the sight of the present disclosure are substantially the same as the specific implementations of the method for switching the reticles of the sight and the specific implementations of the sight capable of switching the reticles, and have the same technical effects, so that they will be not described in detail here.

As described above, one or more embodiments are provided in conjunction with the detailed description, The specific implementation of the present disclosure is not confirmed to be limited to that the description is similar to or similar to the method, the structure and the like of the present disclosure, or a plurality of technical deductions or substitutions are made on the premise of the conception of the present disclosure to be regarded as the protection of the present disclosure.

What is claimed is:

1. A sight capable of switching reticles, comprising:

an objective lens component, wherein the objective lens component is arranged at a first end of an optical channel, and the objective lens component is configured to acquire and image an external light source;

an image acquisition device, wherein the image acquisition device is arranged on one side of the optical channel close to the objective lens component, and the image acquisition device is configured to acquire an image formed by the objective lens component and generate image data;

a display device, wherein the display device is arranged on one side of the optical channel away from the objective lens component, and the display device is configured to display the image and the reticles;

a controller, wherein the controller is electrically connected to the image acquisition device and the display device, and the controller is configured to acquire the image data and transmit the image data to the display device; and the controller receives a reticule instruction and adjusts a size of the reticles according to the reticule instruction; and an eyepiece component, wherein the eyepiece component is arranged at a second end of the optical channel, and the eyepiece component is configured to magnify the formed image on the display device.

2. The sight capable of switching the reticles according to claim 1, wherein the reticles comprise a first reticule and a second reticule, and the controller receives the reticule instruction and displays the first reticule or the second reticule according to the instruction.

3. The sight capable of switching the reticles according to claim 2, wherein a size and magnification of the first reticule change synchronously.

4. The sight capable of switching the reticles according to claim 3, wherein the first reticule comprises a first-unit first reticule and a second-unit first reticule; and the controller receives the reticule instruction and displays the first-unit first reticule or the second-unit first reticule according to the instruction.

5. The sight capable of switching the reticles according to claim 2, wherein a size of the second reticule is fixed.

6. The sight capable of switching the reticles according to claim 5, wherein the second reticule comprises a first-unit second reticule and a second-unit second reticule; and the controller receives the reticule instruction and displays the first-unit second reticule or the second-unit second reticule according to the instruction.

7. A method for switching reticles of a sight, comprising:

acquiring image data generated by an image acquisition device according to an image formed by an objective lens component;

transmitting the image data to a display device, and form an image on the display device to allow the image to be observed through the objective lens component; and receiving a reticule instruction, adjusting a size of the reticles according to the reticule instruction, and controlling the display device to display the reticles.

8. The method for switching the reticles of the sight according to claim 7, wherein the reticles comprise a first reticule and a second reticule, and the controller receives the reticule instruction and displays the first reticule or the second reticule according to the instruction.

9. The method for switching the reticles of the sight according to claim 8, wherein a size and magnification of the first reticule change synchronously.

10. The method for switching the reticles of the sight according to claim 9, wherein the first reticule comprises a first-unit first reticule and a second-unit first reticule; and the controller receives the reticule instruction and displays the first-unit first reticule or the second-unit first reticule according to the instruction.

11. The method for switching the reticles of the sight according to claim 8, wherein a size of the second reticule is fixed.

12. The method for switching the reticles of the sight according to claim 11, wherein the second reticule comprises a first-unit second reticule and a second-unit second reticule; and the controller receives the reticule instruction and displays the first-unit second reticule or the second-unit second reticule according to the instruction.

13. A device for switching reticles of a sight, comprising:

an image acquisition unit, wherein the image acquisition unit is configured to acquire an image formed by an objective lens component and generate image data;

a display unit, wherein the display unit is configured to receive the image data and display an image and the reticles; and a control unit, wherein the control unit is electrically connected to the image acquisition unit and the display unit, and the control unit is configured to acquire the image data and transmit the image data to the display unit; and the control unit is further configured to receive a reticule instruction and adjust a size of the reticles according to the reticule instruction.

14. The device for switching the reticles of the sight according to claim 13, wherein the reticles comprise a first reticule and a second reticule, and the controller receives the reticule instruction and displays the first reticule or the second reticule according to the instruction.

15. The device for switching the reticles of the sight according to claim 14, wherein a size and magnification of the first reticule change synchronously.

16. The device for switching the reticles of the sight according to claim 15, wherein the first reticule comprises a first-unit first reticule and a second-unit first reticule; and the controller receives the reticule instruction and displays the first-unit first reticule or the second-unit first reticule according to the instruction.

17. The device for switching the reticles of the sight according to claim 14, wherein a size of the second reticule is fixed.

18. The device for switching the reticles of the sight according to claim 17, wherein the second reticule comprises a first-unit second reticule and a second-unit second reticule; and the controller receives the reticule instruction and displays the first-unit second reticule or the second-unit second reticule according to the instruction.

* * * * *